US006170142B1

(12) United States Patent
Paterson

(10) Patent No.: US 6,170,142 B1
(45) Date of Patent: Jan. 9, 2001

(54) ROLLER CHAIN LINK RETAINER TOOL

(76) Inventor: Daniel E. Paterson, 1275 Timber Valley Rd., Colo. Sprgs., CO (US) 80919

( * ) Notice: Under 35 U.S.C. 154(b), the term of this patent shall be extended for 0 days.

(21) Appl. No.: 09/267,805

(22) Filed: Mar. 12, 1999

Related U.S. Application Data

(60) Provisional application No. 60/078,665, filed on Mar. 18, 1998.

(51) Int. Cl.[7] ..... B25B 27/14
(52) U.S. Cl. ..... 29/281.5; 29/283
(58) Field of Search ..... 81/467, 176.15; 29/281.5, 283; 269/217, 31, 37, 296

(56) References Cited

U.S. PATENT DOCUMENTS

| | | | | |
|---|---|---|---|---|
| 752,074 | | 2/1904 | Jackson . | |
| 1,000,867 | | 8/1911 | Widmayer et al. . | |
| 1,817,628 | | 8/1931 | Kessler et al. . | |
| 2,622,389 | | 12/1952 | Sjostrom et al. . | |
| 2,826,893 | | 3/1958 | Falk et al. . | |
| 2,950,899 | | 8/1960 | Wilson . | |
| 3,379,005 | | 4/1968 | Jones . | |
| 3,648,973 | | 3/1972 | Farrell . | |
| 4,030,286 | | 6/1977 | Gibilaro . | |
| 4,394,810 | | 7/1983 | Womble . | |
| 4,506,501 | | 3/1985 | DeVall et al. . | |
| 5,154,102 | * | 10/1992 | Becker | 81/176.15 |
| 5,203,158 | | 4/1993 | Bowers . | |
| 5,251,341 | | 10/1993 | Seals . | |
| 5,303,439 | | 4/1994 | Seals . | |
| 5,899,124 | * | 5/1999 | Cross, Jr. | 81/176.15 |
| 5,906,147 | * | 5/1999 | Price, III | 81/461 |

FOREIGN PATENT DOCUMENTS

| | | | | |
|---|---|---|---|---|
| 622651 | * | 2/1926 | (FR) | 81/90 |

OTHER PUBLICATIONS

The Third Hand Bicycle Tools Catalog, Winter 1996–97, p. 24.

* cited by examiner

*Primary Examiner*—David A. Scherbel
*Assistant Examiner*—Daniel Shanley
(74) *Attorney, Agent, or Firm*—Donald W. Margolis

(57) ABSTRACT

The unitary, hand held tool is comprised of a body portion having first and second ends. The body has a length dimension which is sufficient to span the distance between the centers of at least three outer link plates of a multi-link roller chain. The first and second fixed prongs emanate from, are integral with the body portion, and are preferably angled towards one another. The fixed prong adjacent to the first end of the body portion, and the second fixed prong adjacent to the second end of the body portion extend from the linear body portion in substantially the same plane. The prongs are dimensioned to fit into the openings between spaced apart rollers of a multi-link roller chain, and long enough to secure such spaced apart rollers when fit into such openings. In preferred embodiments there is a curved surface between the first fixed prong and the body portion and also a curved surface between the second fixed prong and the body portion, each curved surface having an inner diameter at least equal to or greater than the outer diameter of the rollers of the multi-link roller chain with which it is to be used, to thereby serve to seat the rollers within the curved surfaces.

9 Claims, 1 Drawing Sheet

ROLLER CHAIN LINK RETAINER TOOL

RELATED U.S. APPLICATION DATA

This application claims the benefit of and is a continuation in part of United States Provisional Application Serial No. 60/078,665 filed Mar. 18, 1998 for ROLLER CHAIN LINK RETAINER.

BACKGROUND OF THE INVENTION

1. Field of the Invention

The present invention relates generally to a manually operated hand tool for assembling and disassembling the links of a sprocket roller chain. More specifically it relates to such a tool for holding and retaining a link roller chain in place so that the chain can be assembled or disassembled to remove or replace link plates, rollers, link pins, or a link assembly of a roller chain.

2. Description of Prior Art

Prior art tools exist for performing repairs on roller chains and on other roller chains. Such tools include roller chain tighteners, pin and link removing tools, positioning tools, chain clamps and the like. Prior art roller chain link retainers have either had movable jaws, or flanges, or stationary prongs, or pegs or blocks to fit between rollers. They are usually either extremely unwieldy, or have difficulty in restraining the roller chain, or are a combined restraining and repair device which is not convenient to use for either purpose or function. Many prior art devices are unsuitable for in situ repairs on a bicycle, or they do not perform their function satisfactorily, or are difficult to hold while attaching to a roller chain.

It is therefore seen that the prior art fails to teach or suggest a tool which is designed to be lightweight, hand held, easy to grip, and compact, thereby facilitating easy use and storage. Furthermore, the prior art fails to teach or suggest such a tool which provides a needed function at a relatively inexpensive cost for the repair of a roller chain. Neither does the prior art teach nor suggest a tool that makes the repair task less difficult and reduces the time that it takes to perform repairs, nor does it describe such a tool that grips the chain and restrains it, thus freeing a persons hands to concentrate on the repair action versus having to hold the chain together and perform the repairs at the same time.

SUMMARY OF THE INVENTION

It is therefore an object of the present invention to provide a tool which is designed to be lightweight, hand held, easy to grip, and compact, for use in quickly, easily and releasably securing a roller chain during a repair operation.

It is another object of the present invention to provide such a tool which has little bulk, and which is lightweight and easily stored.

It is still yet another object of the present invention to provide such a tool which has specific utility for use in a roller chain repair operation.

It is yet a further another object of the present invention to provide such a preformed tool which makes the repair task less difficult and reduces the time it takes to perform repairs.

It is still a further object of the present invention to provide a tool which grips the chain and restrains it, thus freeing a persons hands to concentrate on the repair action versus having to hold the chain together and perform the repairs at the same time.

As noted above, the present invention relates generally to a manually operated preformed, unitary hand tool for assembling and disassembling the links of a roller chain. More specifically it relates to such a tool which has a single function, to hold and retain a link roller chain in place so that the chain can be assembled or disassembled under tension in situ. It thereby enables the removal or replacement of link plates, rollers, link pins or a link assembly of a roller chain.

The unitary, hand held tool of the present invention is comprised of a substantially linear body portion having first and second ends. The body has a length dimension which is sufficient to span the distance between the centers of at least three outer link plates of a multi-link roller chain. The first and second fixed prongs emanate from, are integral with the linear body portion, and are preferably angled towards one another. The fixed prong adjacent to the first end of the body portion, and the second fixed prong adjacent to the second end of the body portion extend from the linear body portion in substantially the same plane. The prongs are dimensioned to fit into the openings between spaced apart rollers of a multi-link roller chain, and long enough to secure such spaced apart rollers when fit into such openings. In preferred embodiments there is a curved surface between the first fixed prong and the body portion and also a curved surface between the second fixed prong and the body portion, each curved surface having an inner diameter at least equal to or greater than the outer diameter of the rollers of the multi-link roller chain with which it is to be used. As a result, when the fixed prongs of the hand held unitary tool are placed in the openings of spaced apart rollers, the rollers are seated within the curved surfaces.

The unitary hand held tool of the present invention is useful for holding in place and retaining a multi-link roller chain having openings between the rollers so that the chain can be assembled or disassembled in situ to enable the removal or replacement of link plates, rollers, link pins, or a link assembly. The unitary tool is manufactured from a strong lightweight material.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
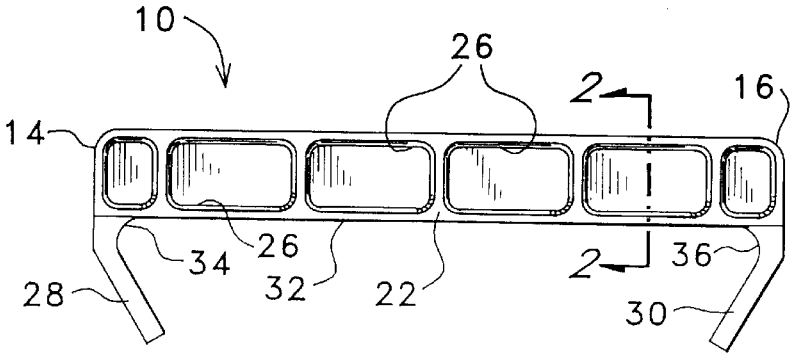
FIG. 1 is a front elevation view showing the chain roller retaining tool of the preferred embodiment of the present invention.
Figure 2:
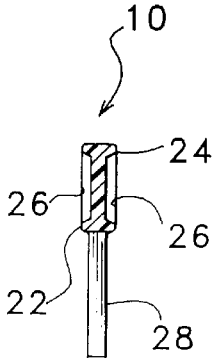
FIG. 2 is a cross-sectional view of the tool through section 2—2 of FIG. 1.
Figure 3:
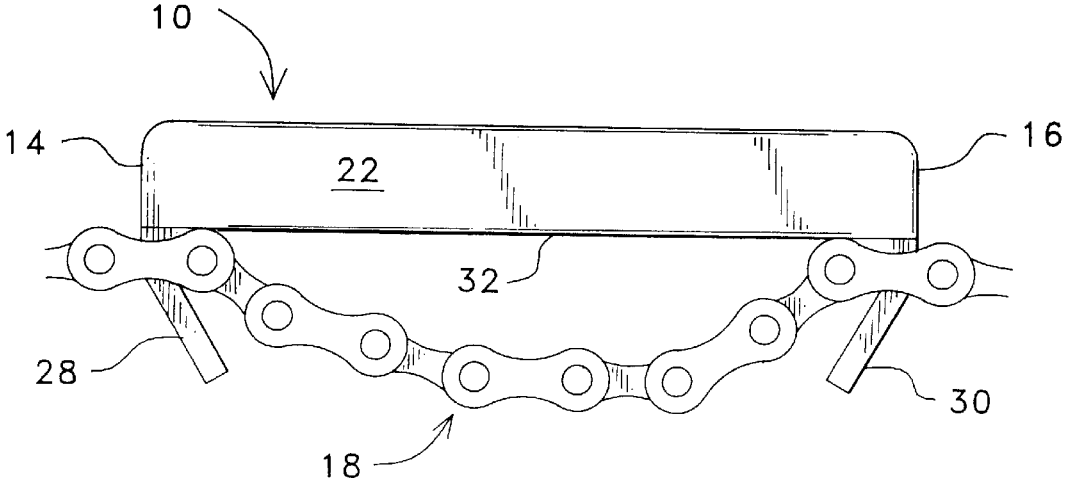
FIG. 3 is a front elevational view of another embodiment of the tool of the present invention shown retaining a roller link chain.

FIG. 1 and FIG. 2 show the preferred embodiment of the preformed, unitary hand tool, generally 10, of the present invention. Tool 10 has a substantially linear, rectilinear body portion. The body portion 12 has a first end 14 and a second opposed end 16, and a length dimension between first end 14 and second end 16 which is sufficient to span the distance between the centers of at least three outer link plates of a multi-link roller chain 18, see FIG. 3. The body portion 12 has first and second opposed side surfaces 22 and 24, and a bottom surface 32, which is preferably flat, but may be curved. In preferred embodiments at least one of the side surfaces 22 and 24 includes a structure, such as indented sections 26, to facilitate gripping tool 10, although both side surfaces 22 and 24 may be so indented. Other patterns and raised surfaces may be used for the same purpose. In other embodiments, see FIG. 3, at least one of the side surfaces 22 and 24 may be substantially flat, although both side surfaces 22 and 24 may be flat.

First and second prongs 28 and 30 emanate from, are fixed to and integral with body portion 12. The first fixed prong 28 is adjacent to first end 14 of body portion 12, and second fixed prong 30 is adjacent to second end 16 of body portion 12. It will be noted that fixed prongs 28 and 30 emanate from linear body portion 12 in substantially same plane. The first and second fixed prongs 28 and 30 are angled towards one another along bottom flat surface 32. The angle of prongs 28 and 30 allow them to quickly obtain acquisition of the links of roller chain 18 and restrain them while in tension in a manner which will not be easily dislodged. Each of the prongs 28 and 30 are dimensioned to fit into the openings which are normally found between spaced apart rollers of multi-link roller chain 18, and are long enough to secure such spaced apart rollers when fit into such openings. However, the outer dimensions of prongs 28 and 30 are preferably slightly smaller than the link openings, thus creating a loose fit which makes it easy to insert the prongs into the links. In preferred embodiments there is a curved surface 34 between first fixed prong 28 and bottom flat surface 32 of body portion 12, and a similar curved surface 36 between bottom flat surface 32 of body portion 12 and second fixed prong 30. Each curved surface 34 and 36 has an inner diameter at least equal to or greater than the outer diameter of the rollers of the multi-link roller chain 18 with which it is to be used. It will be noted that tool 10 has no moving parts, thereby simplifying its use.

It will be appreciated that in use, the link to be repaired is positioned between fixed prongs 28 and 30 of the preformed, unitary hand held tool 10. The fixed prongs 28 and 30 are then placed in the openings of spaced apart rollers, the rollers are seated with stability within curved surfaces 34 and 36, and other tools are not required to restrain the chain.

It is thus seen that the preformed, unitary hand held tool 10 is useful for holding in place and retaining a multi-link roller chain 18 having openings between the rollers so that the chain can be assembled or disassembled under tension, in situ to enable the removal or replacement of link plates, rollers, link pins, or a link assembly. In preferred embodiments, the length dimension of body portion 12 of tool 10 is slightly shorter than the encompassed dimension between the chain links, so that, when the first and second fixed prongs 28 and 30 are inserted into the openings of spaced apart rollers of a roller chain 18 in situ a dip is produced in chain 18 to hold the to-be-repaired portion in place in a relaxed state to thereby facilitate repair of the damaged link.

The tool 10 of the present invention is manufactured from a strong lightweight material, such as metal or plastic, the only requirement being that the material have sufficient strength to withstand an initial in situ chain pull and chain tension. Because it is lightweight and compact, it is extremely portable, thereby making it easy for a user to carry. Without tool 10 of the present invention, it is extremely difficult for one person to hold both ends of a chain at the same time while performing repairs. This is especially true if the chain has broken in two. Unassisted by another person, it could take a significant time to repair the chain without this tool. As a result, without the tool 10 of the present invention, two people are usually needed to make a quick repair of a chain, one to hold the chain, the other to connect or use the repair tool. Due to its size, the tool 10 can be easily carried by a person or stored in a small tool carrying case.

Therefore, as taught herein, the tool 10 of the present invention is designed to be light weight, hand held, easy to grip, and compact, thereby facilitating easy use and storage. Because of this, it provides a needed function at a relatively inexpensive cost for the repair of a roller chain. The tool 10 makes the repair task less difficult and reduces the time it takes to perform repairs. As described above, it grips the chain and restrains it, thus freeing a persons hands to concentrate on the repair action versus having to hold the chain together and perform the repairs at the same time. The amount of time taken to perform such repair could be critical, for example in a bicycle race, or even to casual riders when limited time or ease of repairs is important. Also, it permits one person to easily and conveniently make chain repairs.

Modifications and changes are possible without changing the scope of the tool described herein. These could include, but are not limited, to the material of which the tool is made, the configuration, size, or shape of the holding surface, curvature, and prongs, or the angle of the prongs.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A unitary, single piece, hand held tool for holding and retaining a multi-link roller chain having openings between the rollers in place so that the chain can be assembled or disassembled in situ to enable the removal or replacement of link plates, rollers, link pins, or a link assembly, the tool comprising:

a body portion having first and second ends, said body having a length dimension which is sufficient to span the distance between the centers of at least three outer link plates of a multi-link roller chain, said first and second ends being opposed to one another;

first and second fixed prongs integral with said body portion, said first fixed prong adjacent to said first end of said body portion, and said second fixed prong adjacent to said second end of said body portion, said first and second fixed prongs extending from said body portion in substantially the same plane, said first and second extending fixed prongs being angled towards one another, said first and second fixed prongs dimensioned to fit into the openings between spaced apart rollers of a multi-link roller chain, and long enough to secure such spaced apart rollers when fit into such openings; whereby said unitary hand held tool is useful for holding in place and retaining a multi-link roller chain having openings between the rollers so that the chain can be assembled or disassembled in situ to enable the removal or replacement of link plates, rollers, link pins, or a link assembly.

2. The unitary tool of claim 1 wherein there is a curved surface between said first fixed prong and said body portion and a curved surface between said second fixed prong and said body portion, each said curved surface having an inner diameter at least equal to or greater than the outer diameter of the rollers of the multi-link roller chain with which it is to be used, whereby, when said fixed prongs of said hand held unitary tool are placed in the openings of spaced apart rollers, the rollers are seated within the curved surfaces.

3. The unitary tool of claim 2 wherein said first and second fixed prongs are angled towards one another.

4. The unitary tool of claim 1 wherein said length dimension of said body portion of said unitary tool is such that when said first and second fixed prongs are inserted into the openings of spaced apart rollers of a roller chain in situ a dip is produced in the chain to facilitate repairs.

5. The unitary tool of claim 1 wherein said body portion is substantially rectilinear in shape and has first and second opposed side surfaces, said side surfaces being substantially flat.

6. The unitary tool of claim 1 wherein said body portion is substantially rectilinear in shape and has first and second opposed side surfaces, at least one of said side surfaces including means to facilitate gripping the unitary tool.

7. The unitary tool of claim 6 wherein at least one of said side surfaces including indented sections to facilitate gripping.

8. The unitary tool of claim 6 wherein both said first and second opposed side surfaces include indented sections to facilitate gripping.

9. The unitary tool of claim 1 wherein said body portion is manufactured from a strong lightweight material selected from the group consisting of metal and of plastic.

* * * * *